US005681199A

United States Patent [19]

Morris

[11] Patent Number: 5,681,199

[45] Date of Patent: Oct. 28, 1997

[54] BOOK HAVING A POP-UP TOY

[75] Inventor: Michael J. Morris, Weston, Conn.

[73] Assignee: Joshua Morris Publishing, Inc., Westport, Conn.

[21] Appl. No.: 723,728

[22] Filed: Sep. 30, 1996

[51] Int. Cl.[6] ..... A63H 3/00; A63H 33/38; A63H 13/16; B42D 1/00

[52] U.S. Cl. ..... 446/73; 446/148; 446/310; 281/15.1; 281/51

[58] Field of Search ..... 446/147, 148, 446/150, 151, 72, 73, 297, 309, 310, 311; 281/15.1, 51

[56] References Cited

U.S. PATENT DOCUMENTS

| | | | |
|---|---|---|---|
| D. 159,283 | 7/1950 | Sivitz . | |
| D. 206,596 | 1/1967 | Ryan . | |
| D. 237,400 | 10/1975 | Subbmann . | |
| 428,795 | 5/1890 | von Auw . | |
| 1,490,295 | 4/1924 | Stephens . | |
| 1,848,980 | 3/1932 | Walker | 281/51 |
| 2,367,373 | 1/1945 | Ralston . | |
| 2,473,938 | 6/1949 | Cannizzaro et al. . | |
| 2,742,287 | 4/1956 | Barker | 446/310 |
| 3,918,180 | 11/1975 | Chamberlin . | |
| 4,425,098 | 1/1984 | Döring . | |
| 4,490,123 | 12/1984 | Becker et al. . | |
| 4,752,230 | 6/1988 | Shimizu . | |
| 4,809,246 | 2/1989 | Jeng . | |
| 4,832,648 | 5/1989 | Theobald et al. | 446/72 |
| 4,877,269 | 10/1989 | Callaghan et al. . | |
| 5,059,149 | 10/1991 | Stone | 446/73 |
| 5,509,149 | 4/1996 | Stone . | |
| 5,533,757 | 7/1996 | Morris . | |

FOREIGN PATENT DOCUMENTS

| | | | |
|---|---|---|---|
| 2517878 | 11/1976 | Germany | 281/51 |
| 567972 | 10/1957 | Italy | 446/147 |

*Primary Examiner*—Robert A. Hafer
*Assistant Examiner*—Laura Fossum
*Attorney, Agent, or Firm*—Kenyon & Kenyon

[57] ABSTRACT

A book wherein one or more of the covers or pages are bound with a binding adapted for accepting a conduit, and a toy figure is movably extending within the conduit. The toy figure includes a top portion and an engaging portion. An activating device is also provided with the book. The activating device is actuated to extend the toy figure within the conduit using the bottom portion of the toy figure. A musical device may be provided within the conduit to generate a sound for a predetermined time period after the activating device is actuated.

19 Claims, 4 Drawing Sheets

BOOK HAVING A POP-UP TOY

FIELD OF THE INVENTION

The present invention relates to a children's book, and more particularly to a child's book including a pop-up toy.

BACKGROUND INFORMATION

As a way of inducing children to learn to read, persons have created stories about creatures engaged in human endeavors. For example, stories about animals, insects, and even plant life have been created wherein these creatures speak and behave like humans and wherein they engage in human-like activities. Stories of this nature have been found to attract the interest of children, thereby encouraging them to read more often.

In addition to the subject matter of the story, it has been found that illustrations play an important role in attracting a child's interest. Hence, children's story books have been provided with large, colorful pictures illustrating the subject matter or the background thereof.

The prior art has been somewhat successful in creating books which teach children to read. For example, U.S. Pat. No. 4,819,963 describes a book which is sculptured in the shape of a fish or other form, apparently for the purpose of gaining the interest of children. However, it would be desirable to further attract the interest of children in order to even better encourage their learning to read.

Other devices have attempted to stimulate children to read. U.S. Pat. No. 5,533,757 describes a book having a sound producing capability. The child is stimulated to read the book by the sounds that are generated.

SUMMARY OF THE INVENTION

It is an object of the present invention to provide a children's book having features which attract the attention and interest of young children by providing a pop-up toy with the children's book.

It is a further object of the present invention to provide a children's book including a pop-up toy which is exhibited when a switch is activated.

It is a further object of the present invention to provide such a book with the pop-up toy provided in a hollow spine of the book, therefore permitting a reader of the book to exhibit the pop-up toy while reading the book.

It is yet a further object of the present invention is to provide a child's book wherein the pop-up toy is exhibited after a user turns a crank clockwise or counterclock for a predetermined number of rotations. The crank is usually rotated to play a predefined tune (e.g., "pop goes the weasel"), and thereafter, the pop-up toy (e.g., a weasel) pops-up from the spine of the book.

These and other objects of the invention which will become apparent from the following detailed description are achieved as follows. The invention is a book having a front cover, a back cover, and a multiplicity of pages therebetween, all of which are bound along one side with a binding. The binding is adapted for receiving or defining a housing which has a preferably cylindrical shape. A toy is provided in the housing with a head portion and a bottom portion attached to the head portion. An activating device (such as a crank handle, a turn-key, a button, a pull cord or a pull stick) is provided on the binding to pop the toy out from the housing using the bottom portion of the toy.

Additional elements may be utilized with the present invention. For example, the book may also include a musical device coupled to the activating device. The musical device is actuated by the activating device to generate a sound for a predetermined period of time, after which the toy is popped up from the housing. Preferably, the bottom portion of the toy is a spring member. The spring member is generally compressed when the toy is pushed into the housing.

Preferably, the housing includes a top closure member to cover the toy when placed in the housing. The activating device actuates the musical device to generate a sound or a plurality of sounds a predetermined duration, after which, the spring member is released (either by releasing a holding member which compresses the spring member or by opening the top closure member), and the toy is popped up from the housing.

Another embodiment of the present invention may include the activating device between the pages of the book, or between the covers and the pages of the book. The user would be able to actuate the activating device when the user reaches the location of the activating device when reading the book. Furthermore, the activating device may include sensors positioned between the pages of the book (or between the pages of the book and the covers). The activating device would be actuated to pop up the toy when the user reaches prespecified pages of the book.

The toy is preferably a character of the book. Thus, when the toy pops up, the user's interest in the store is further stimulated. Specifically, a child would be inspired to read the book and enhance his or her learning capacity.

DETAILED DESCRIPTION OF THE INVENTION

Figure 1:
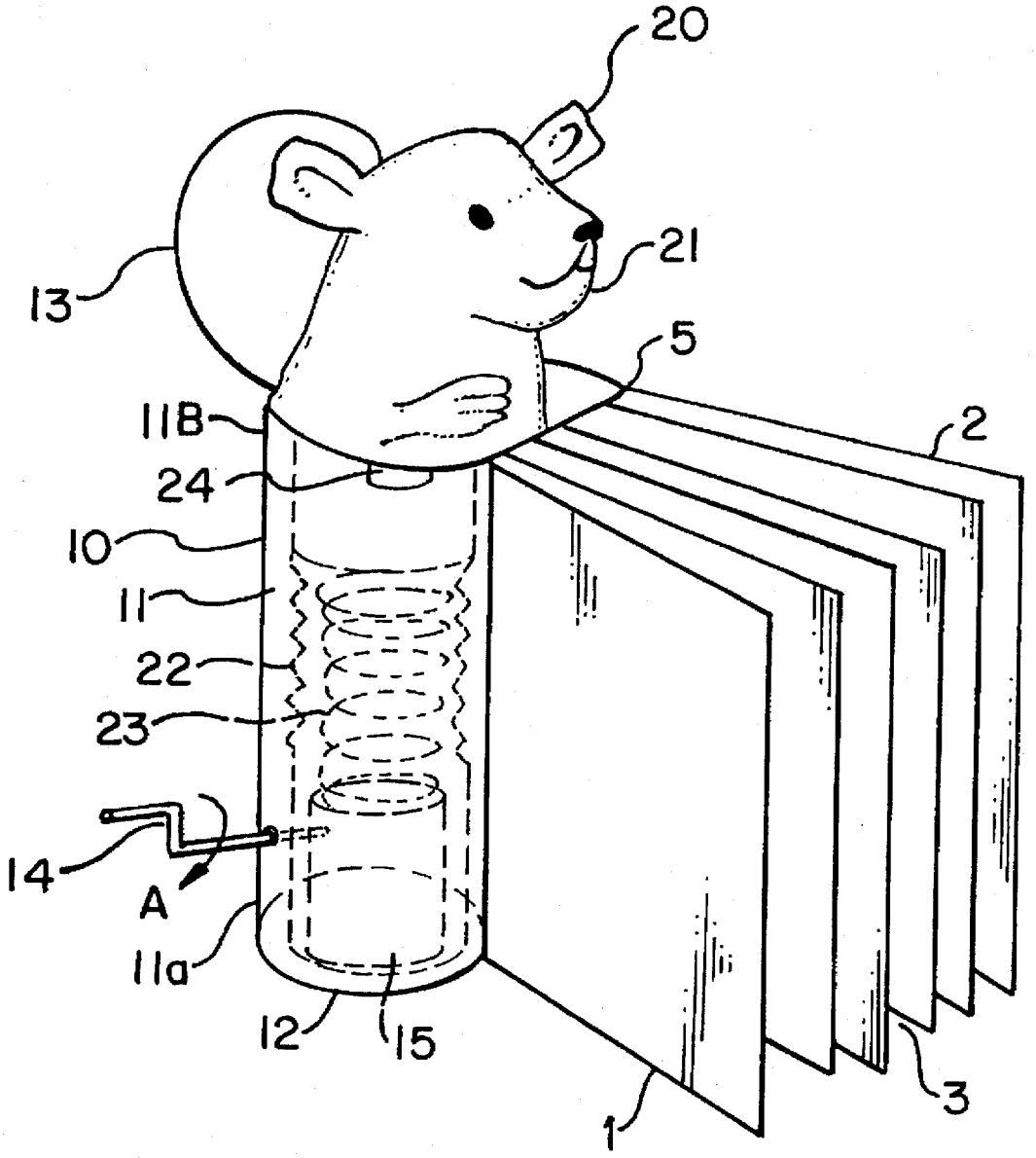
FIG. 1 shows a first embodiment of a book according to the present invention with a crank handle.

Referring to FIG. 1, a first embodiment of a book according to the present invention is illustrated. The book includes a front cover 1, a back cover 2, and a multiplicity of pages 3. The covers 1 and 2 and the pages 3 are bound along one common side thereof by a binding 5 in a conventional and well known manner. The binding 5 can be any conventional binding such as glue, staples, rings, etc. Of course, binding 5 permits the covers and the pages to be turned as in any conventional book. The book includes an enlarged spine 10 for inserting a housing 11. The spine 10 is attached to the binding 5 using any standard method of attachment; additionally, the spine 10 may be a continuation of the same material as binds the front cover 1 and the back cover 2 of the book.

In a preferred embodiment of the present invention, the housing 11 is inserted in the spine 10. The housing 11 and the spine 10 are extended along the length of the binding 5. The housing 11 is preferably cylindrical, however, other shapes of the housing 11 are conceivable. The housing 11 has a bottom closure member 12 and a top closure member 13. The bottom closure member 12 is preferably sealed and positioned at the bottom portion 11*a* of the housing 11. The top closure member 13 is pivotally coupled to the top portion 11*b* of the housing 11. A release mechanism 24 for pivotally opening the top closure member 13 is provided at the top portion 11*b* of the housing 11. The housing 11 also includes a musical device 15. The musical device 15 has, preferably, a cylindric or other rotatable shape, and includes external protrusions. A crank handle 14 is externally positioned on the spine 10 opposite to the binding 5. The crank handle 14 extends through the housing 11 and rotatably couples with the musical device 15. A toy 20 is placed into the housing 11 through a top portion 11*b* of the housing 11. The toy 20, preferably, includes a top toy part 21 (i.e., a head) and a bottom toy part 22 (i.e., a sleeve). The sleeve slides within the housing 11 and removably coupled to the bottom portion 11*a* of the housing 11. Since the sleeve 22 is coupled to the bottom portion 11*b* of the housing, access to the mechanism is very limited, thus preventing such access by a child. The sleeve, preferably, includes a spring member 23 extending from the bottom portion 11*a* of the housing to the head 21 of the toy 20. A holding member (not illustrated) may be used to hold the compressed the spring member 23, thus preventing undesired display of the toy 20 from the housing 11. However, other means to main a constant compression of the spring member of the toy 20 may be utilized. For example, the head 21 of the toy 20 may be pushed below the level of the top portion 11*b* of the housing 11 to compress the spring member 23 and closing the top closure portion 13 above the head 21 of the toy 20. Thus, the toy 20 is springly loaded within the housing 11.

Preferably, the covers 1, 2 and the pages 3 are made of a cardboard to lend structural integrity to the book. Since cardboard is resistant to tearing, the provision of cardboard covers and pages will render the book sturdy and tear-resistant, and hence particularly suitable for the young children.

During operation, a user spins the crank handle 14 in a clockwise (or a counter-clockwise) direction A to spin the musical device 15, and thus, generating a predefined sound (e.g., music). When the musical device 15 has rotated to a predetermined position, a holding member of the sleeve is activated to release the spring member situated in the sleeve 22 of the toy 20. Therefore, the spring member pushes the head 21 of the toy 20 out from the top closure member 11*b* of the housing 11, after the release mechanism 24 is released and the top closure member 11*b* is opened to allow the head 21 to pop out from the housing 11. It is also possible to utilize the present invention without the presence of the holding member by releasing the release mechanism 24 to open the top closure member 11*b*, thus allowing the compressed spring member of the toy 20 to extend and pop the head 21 of the toy 20 out from the housing 11.

Figure 2:
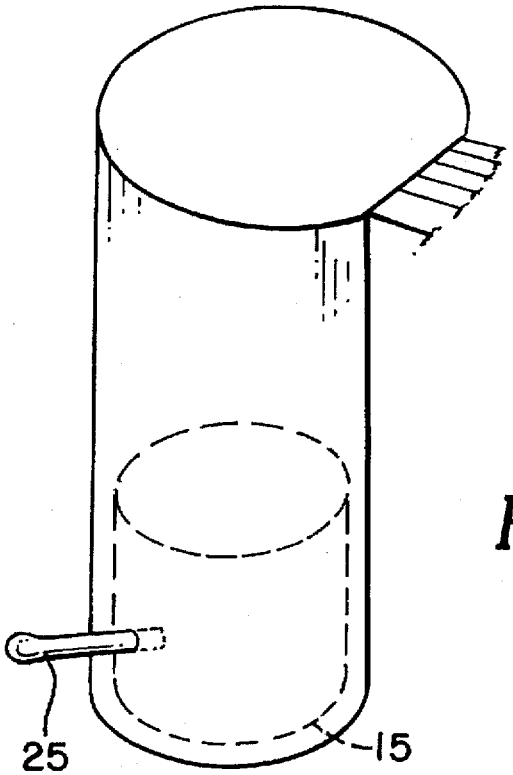
FIG. 2 shows a second embodiment of the present invention having a pull cord or a pull stick.

FIG. 2 illustrates another embodiment of the present invention. The crank handle 14 can be supplemented with a pull cord 25 (or a pull stick). The pull cord 25 may be coupled to the musical device 15, which is activated to generate music by quickly pulling the pull cord 25. The display of the toy 20 would occur in a similar manner as described above with respect to FIG. 1.

Figure 3:
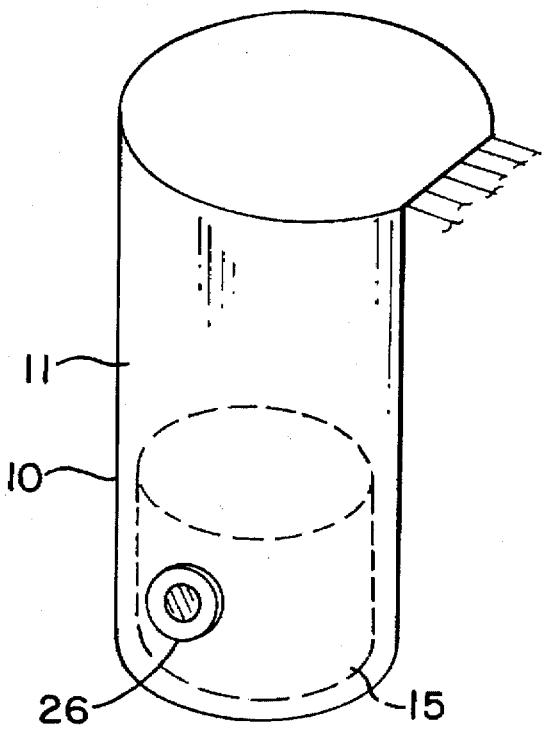
FIG. 3 shows a third embodiment of the present invention having a button.

A further embodiment of the present invention is shown in FIG. 3. Instead of the pull cord 25 or the crank handle 14, a button 26 is provided on the surface of the spine and attached to the housing 11. In this embodiment, the button 26 is coupled (electrically or mechanically) to the musical device 15. By pressing the button 26, the musical device 26 begins rotating (electrically or mechanically), thus displaying the toy 25 out from the housing 11.

Figure 4:
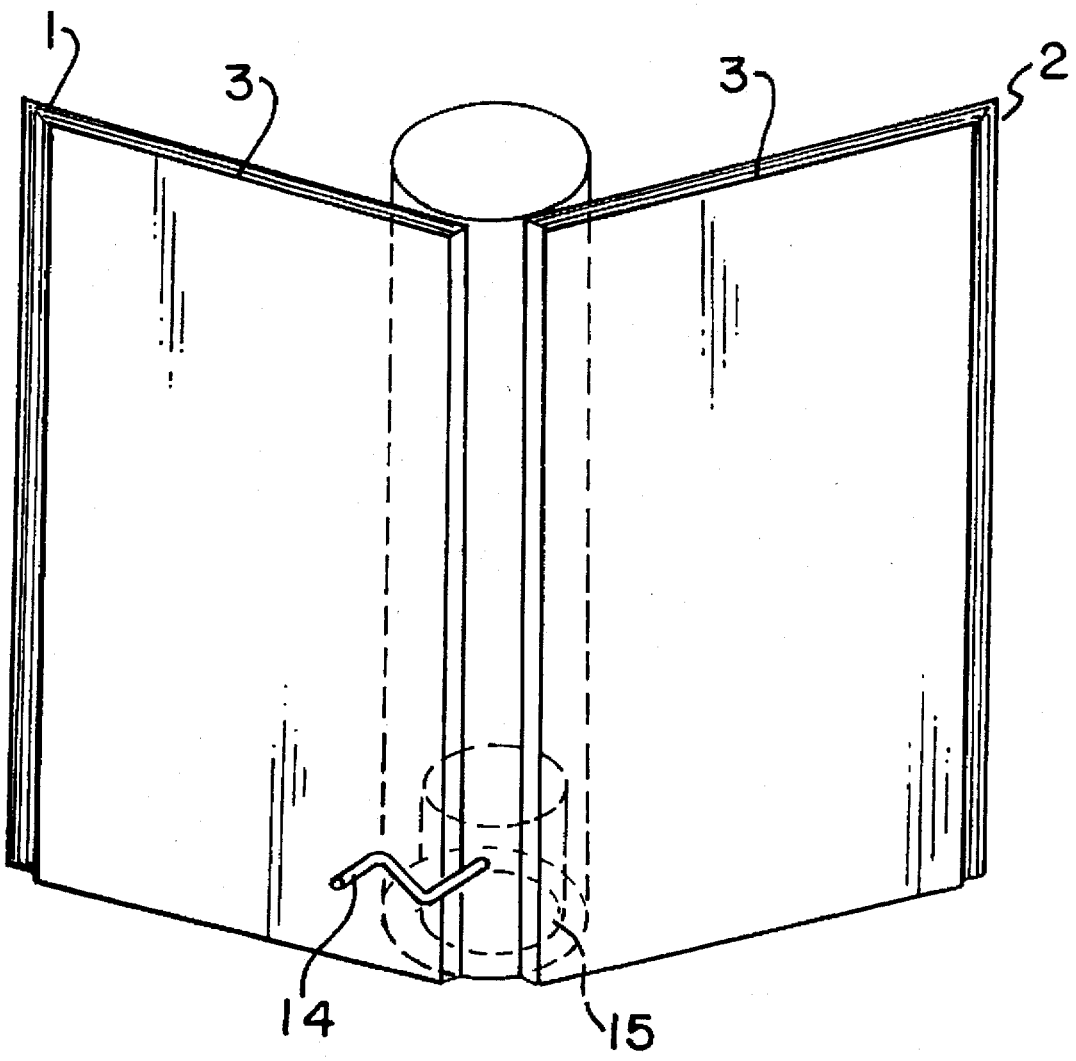
FIG. 4 shows a fourth embodiment of the present invention, with a book in an open position.
Figure 5:
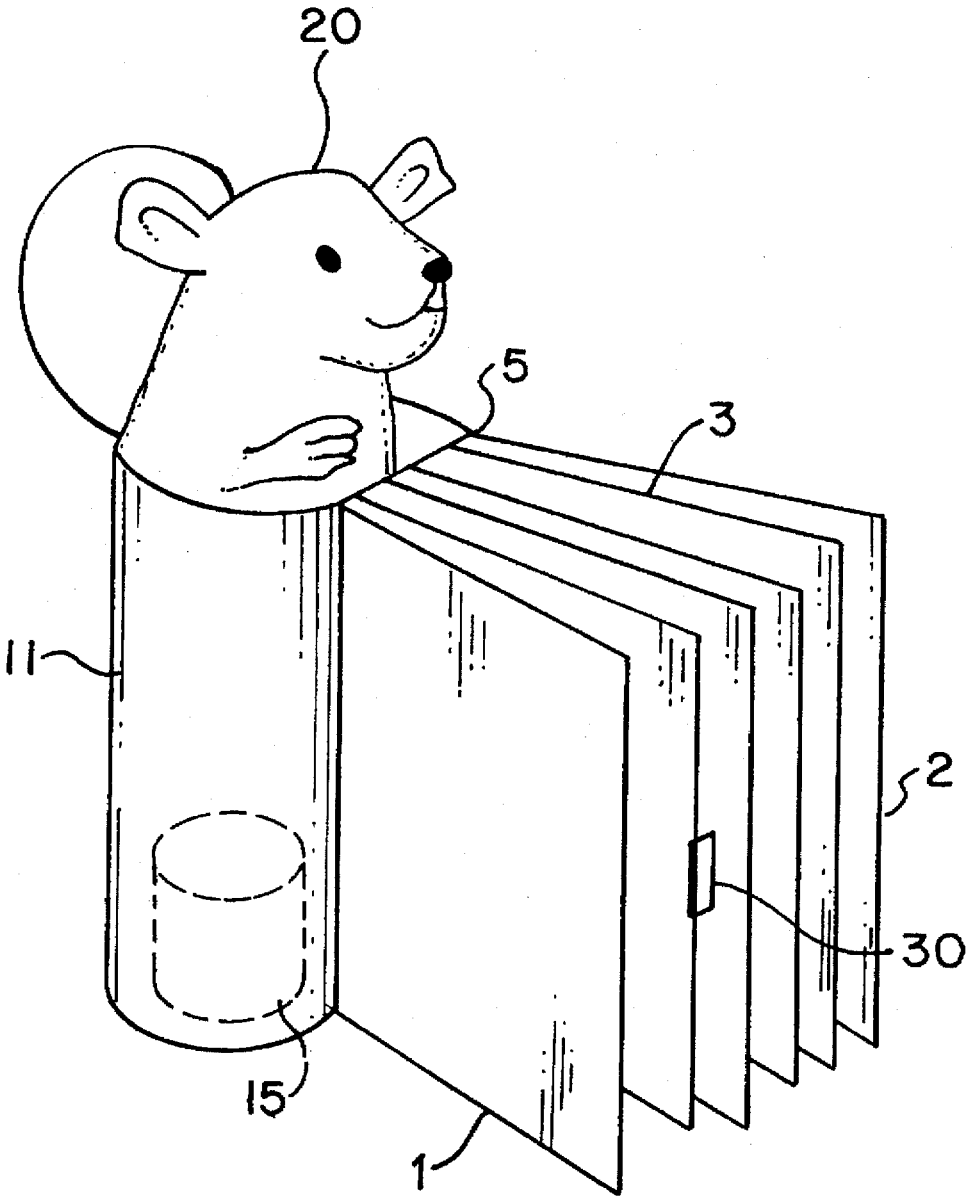
FIG. 5 shows a fifth embodiment of the present invention having a sensor.

In still further embodiment of the present invention as shown in FIG. 4, the crank handle 14 (or the pull cord 25 or the button 26) is positioned between the pages 3 or between the covers 1, 2 and the pages 3. The crank handle 14 is extended through the binding 5 and into the housing 11 to couple to the musical device 15. The placement of the crank handle 14 in such manner allows the user to activate the display of the toy when the user reaches a preselected page location within the book. A sensor 30 (shown in FIG. 5) may be placed in the preselected location of the pages to electrically activate the pop-up of the toy 20 from the housing 20 when the user "flips" to the preselected page (or pages) in the book. For example, when the preselected page 3 in the book is reached, a sensor 30 generates a signal to the musical device 15 to play a song and, after a predetermined amount of time, display the toy 20 from the housing 11.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A book, comprising:

a front cover, a back cover, and a plurality of pages therebetween, the front cover, back cover and pages being bound along one side thereof by a binding;

a conduit positioned within the binding;

a toy figure positioned-in the conduit;

an engaging member for moving the toy figure through the conduit;

an activating member positioned on the binding for actuating the engaging member to extend the toy figure along the conduit;

and at least partially outside the conduit.

2. The book according to claim 1, further comprising a musical device positioned in the conduit and coupled to the activating member, the musical device actuated by the activating member to generate sounds.

3. The book according to claim 2, wherein the musical device has a cylindrical shape, and wherein the activating member includes a crank handle coupled to the musical device, the crank handle being rotatable for actuating the sounds by spinning the musical device.

4. The book according to claim 2, wherein the musical device generates the sounds for a predetermined time period, the engaging member extending the toy figure after the predetermined time period expires.

5. The book according to claim 1, wherein the engaging member includes a spring.

6. The book according to claim 5, wherein the engaging member includes a sleeve member positioned over the spring.

7. The book according to claim 1, further comprising a musical device coupled to the activating member for generating sounds for a predetermined time period; a holding member for extendingly releasing the engaging member after the predetermined time period expires.

8. The book according to claim 1, wherein the activating member includes one of a pull cord and a pull stick.

9. The book according to claim 1, wherein the activating member includes a button.

10. The book according to claim 1, wherein the conduit includes a top closure member for pivotally closing an upper opening of the conduit after the toy figure is placed in the conduit.

11. The book according to claim 10, further comprising a release member for securing the top closure member in a closed position after the toy figure is placed in the conduit.

12. The book according to claim 1, wherein the activating member is positioned between a first page a second page of the plurality of pages.

13. The book according to claim 12, wherein the activating member is accessible to a user when the first and second pages of the plurality of pages are exposed.

14. The book according to claim 1, wherein the activating member is positioned between a last one of the plurality of pages and the back cover.

15. The book according to claim 1, wherein the activating member is positioned between two of the plurality of pages.

16. The book according to claim 1, wherein the toy figure is a character of the book.

17. A book having a first edge and a second edge, the first edge oppositely positioned to the second edge, the book comprising:

a front cover, a back cover, and a multiplicity of pages therebetween, the front cover, back cover and pages being bound along the first edge by a binding;

a conduit positioned within the binding;

a toy figure positioned in the conduit and including an engaging member; and an activating member positioned on the second edge between one of the plurality of pages and another one of the plurality of pages, the activating member being capable of actuating the engaging member to extend the toy figure along the conduit has been inserted.

18. The book according to claim 17, further comprising a musical device positioned in the conduit and coupled to the activating member, the activating member actuating the musical device to generate a sound for a predetermined time period.

19. The book according to claim 18, wherein the activating member caused the toy figure to extend after the predetermined time period expired.

* * * * *

UNITED STATES PATENT AND TRADEMARK OFFICE

CERTIFICATE OF CORRECTION

PATENT No. : 5,681,199

ISSUE DATE : October 28, 1997

INVENTOR(S): MORRIS, M.

It is certified that error appears in the above-identified patent and that said Letters Patent is hereby corrected as shown below:

In column 4, line 39, change "positioned-in" to --positioned in--.

In column 4, line 41, after "conduit;" insert --and--.

In column 4, line 55, change "sounds" to --sound--.

In column 4, line 66, after "comprising" insert --:--.

In column 5, line 1, after "period;" insert --and--.

In column 6, line 17, delete "has been inserted." and insert --and to pop up outside the conduit.--.

In column 6, line 24, change "caused" to --causes--.

Signed and Sealed this

Fourteenth Day of July, 1998

Bruce Lehman

*Attest:*

BRUCE LEHMAN

*Attesting Officer*

*Commissioner of Patents and Trademarks*